US006474625B2

(12) United States Patent
Bevre

(10) Patent No.: US 6,474,625 B2
(45) Date of Patent: Nov. 5, 2002

(54) LAWN TRACTOR MAINTENANCE SYSTEM

(76) Inventor: Alden Bevre, 6552 - 176 1/2 Ave., SE., Wahpeton, ND (US) 58075

( * ) Notice: Subject to any disclaimer, the term of this patent is extended or adjusted under 35 U.S.C. 154(b) by 0 days.

(21) Appl. No.: 09/727,923

(22) Filed: Nov. 30, 2000

(65) Prior Publication Data

US 2002/0063246 A1 May 30, 2002

(51) Int. Cl.[7] ..... B66F 3/00
(52) U.S. Cl. ..... 254/131
(58) Field of Search ..... 254/131, 8 R, 254/8 B, 130, 129, 94, 35; 269/296; 414/426, 563

(56) References Cited

U.S. PATENT DOCUMENTS 3,924,763 A * 12/1975 Pigeon ..... 414/563
4,180,253 A * 12/1979 Ivers et al. ..... 254/131
4,473,334 A * 9/1984 Brown ..... 414/563
4,793,763 A * 12/1988 Bubik ..... 414/563
5,971,360 A * 10/1999 Sinsley ..... 254/131

* cited by examiner

*Primary Examiner*—Robert C. Watson

(57) ABSTRACT

A lawn tractor maintenance system for safely elevating a lawn mower for examination and maintenance. The lawn tractor maintenance system includes a frame, a pair of wheel supports attached to the frame, and a lever arm attached to the frame for allowing an individual to manipulate the frame and wheel supports. A chain is attached to each of the wheel supports for securing the tires of the lawn tractor within the wheel supports during manipulations. The wheel supports and the lever arm are preferably removably attached to the frame for allowing compact storage thereof.

19 Claims, 7 Drawing Sheets

LAWN TRACTOR MAINTENANCE SYSTEM

BACKGROUND OF THE INVENTION

1. Field of the Invention

The present invention relates generally to jack devices and more specifically it relates to a lawn tractor maintenance system for safely elevating a lawn mower for examination and maintenance.

2. Description of the Prior Art

Elevating devices such as jacks have been in use for years. A hydraulic jack is typically comprised of a vertically orientated shaft supported upon a hydraulic cylinder. A floor jack is typically comprised of four wheels attached to a frame with a hydraulic jack and a leverage arm extending upwardly at an angle from the frame so that the distal end thereof elevates the object.

None of the prior art jacks provide a stable elevating system for easily and safely elevating a lawn mower. Lawn mowers do not have an easy to access location upon them for the conventional jack to engage. Conventional jacks are susceptible to falling upon an individual when they are positioned beneath the lawn tractor.

Examples of patented elevating systems which are illustrative of such prior art include U.S. Pat. No. 5,971,360 to Sinsley; U.S. Pat. No. 5,678,804 to Lintelman et al.; U.S. Pat. No. 1,826,110 to Wickman; U.S. Pat. No. 1,014,992 to Ames; U.S. Pat. No. 117,337 to Scoville; U.S. Pat. No. 5,000,423 to Snickers; U.S. Pat. No. 5,832,581 to Barthuli; U.S. Pat. No. 5,716,061 to Sloan et al.; U.S. Pat. No. 5,713,557 to Kang; U.S. Pat. No. 4,113,235 to Hartman, Jr.; U.S. Pat. No. 4,333,617 to Hamilton.

While these devices may be suitable for the particular purpose to which they address, they are not as suitable for safely elevating a lawn mower for examination and maintenance. Conventional jack devices simply do not provide an easy to utilize and safe elevating system for lawn tractors.

In these respects, the lawn tractor maintenance system according to the present invention substantially departs from the conventional concepts and designs of the prior art, and in so doing provides an apparatus primarily developed for the purpose of safely elevating a lawn mower for examination and maintenance.

SUMMARY OF THE INVENTION

In view of the foregoing disadvantages inherent in the known types of jack devices now present in the prior art, the present invention provides a new lawn tractor maintenance system construction wherein the same can be utilized for safely elevating a lawn mower for examination and maintenance.

The general purpose of the present invention, which will be described subsequently in greater detail, is to provide a new lawn tractor maintenance system that has many of the advantages of the jack devices mentioned heretofore and many novel features that result in a new lawn tractor maintenance system which is not anticipated, rendered obvious, suggested, or even implied by any of the prior art elevating devices, either alone or in any combination thereof.

To attain this, the present invention generally comprises a frame, a pair of wheel supports attached to the frame, and a lever arm attached to the frame for allowing an individual to manipulate the frame and wheel supports. A chain is attached to each of the wheel supports for securing the tires of the lawn tractor within the wheel supports during manipulations. The wheel supports and the lever arm are preferably removably attached to the frame for allowing compact storage thereof.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a lawn tractor maintenance system that will overcome the shortcomings of the prior art devices.

A second object is to provide a lawn tractor maintenance system for safely elevating a lawn mower for examination and maintenance.

Another object is to provide a lawn tractor maintenance system that allows an individual to sharpen lawn mower blades and to clean the lawn mower without undue physical exertion.

An additional object is to provide a lawn tractor maintenance system that assists an individual in maintaining their lawn tractor.

A further object is to provide a lawn tractor maintenance system that can be utilized by most individuals.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
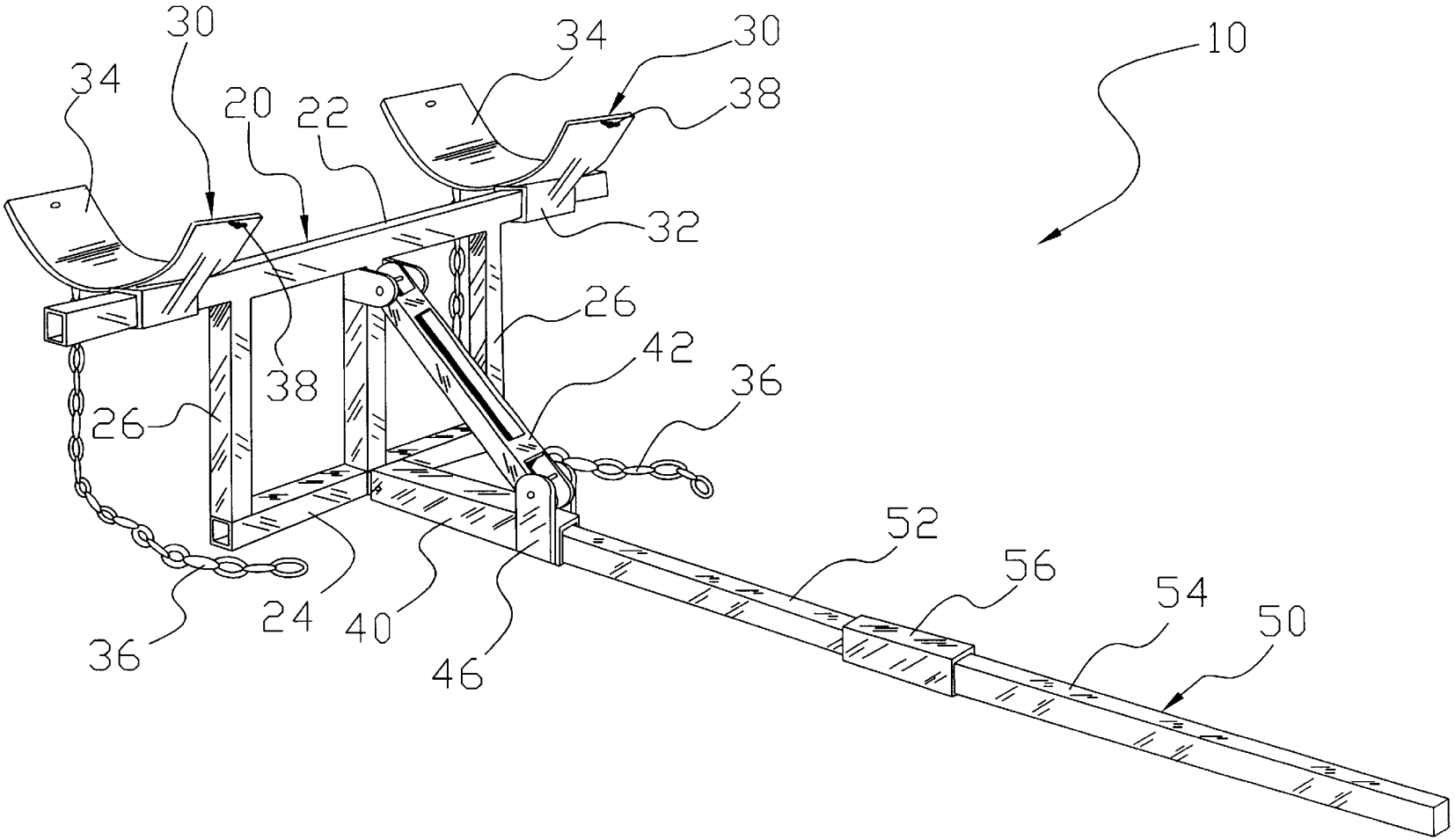
FIG. 1 is an upper perspective view of the present invention.

Turning now descriptively to the drawings, in which similar reference characters denote similar elements throughout the several views, FIGS. 1 through 7 illustrate a lawn tractor maintenance system 10, which comprises a frame 20, a pair of wheel supports 30 attached to the frame 20, and a lever arm 50 attached to the frame 20 for allowing an individual to manipulate the frame 20 and wheel supports 30. A chain 36 is attached to each of the wheel supports 30 for securing the tires 14 of the lawn tractor 12 within the wheel supports 30 during manipulations. The wheel supports 30 and the lever arm 50 are preferably removably attached to the frame 20 for allowing compact storage thereof.

Figure 4:
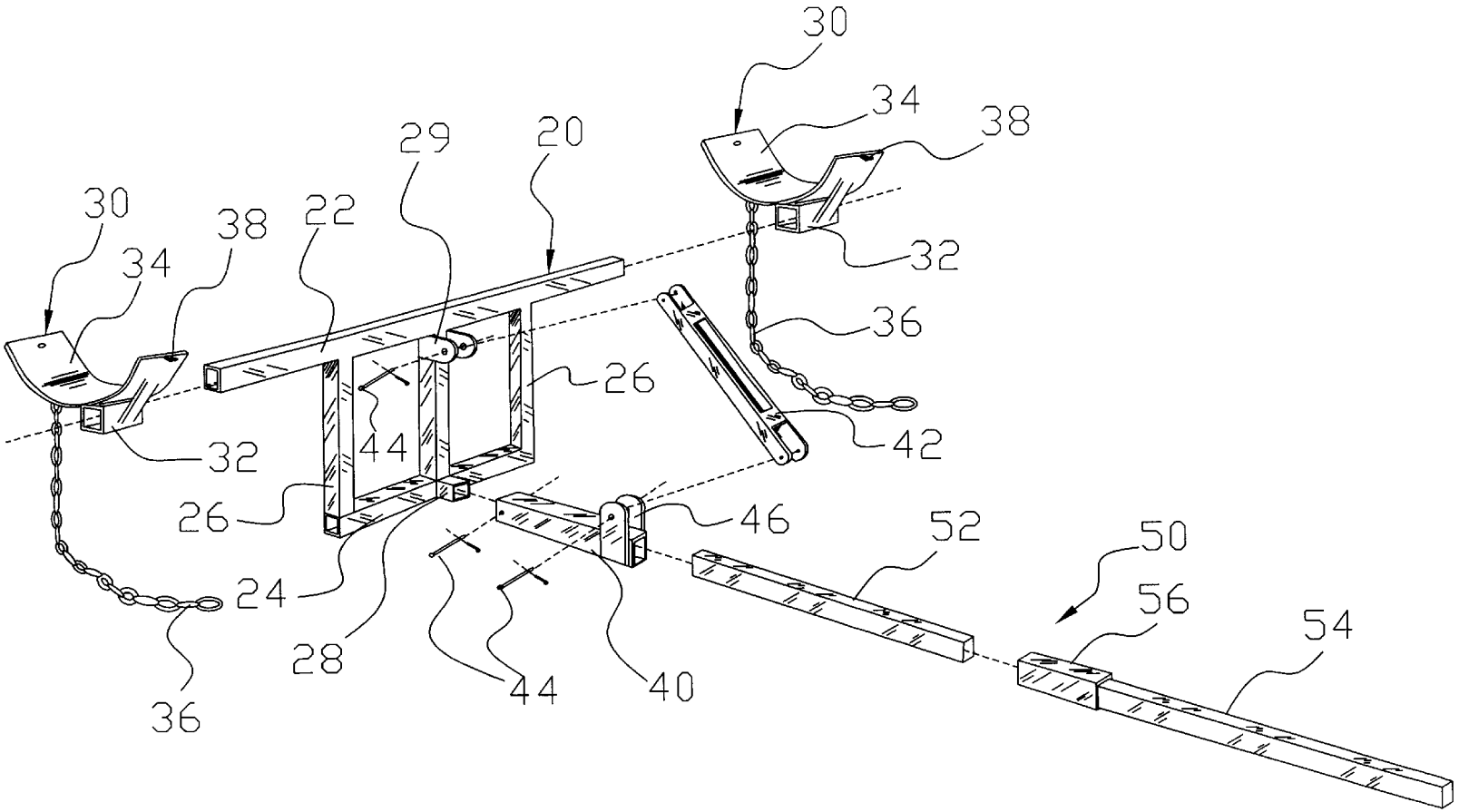
FIG. 4 is an exploded upper perspective view of the present invention.

As best shown in FIG. 4 of the drawings, the frame 20 is comprised of an upper member 22, a base member 24 and a plurality of vertical members 26 extending traversely between the upper member 22 and the base member 24. The upper member 22 preferably extends past the opposing vertical members 26 as further shown in FIG. 4 of the drawings. A tongue member 28 extends from the center of the base member 24 for receiving a lower member 40 as best shown in FIG. 4 of the drawings. A first bracket 29 extends from the frame 20 for receiving a distal end of an angled brace 42.

Figure 5:
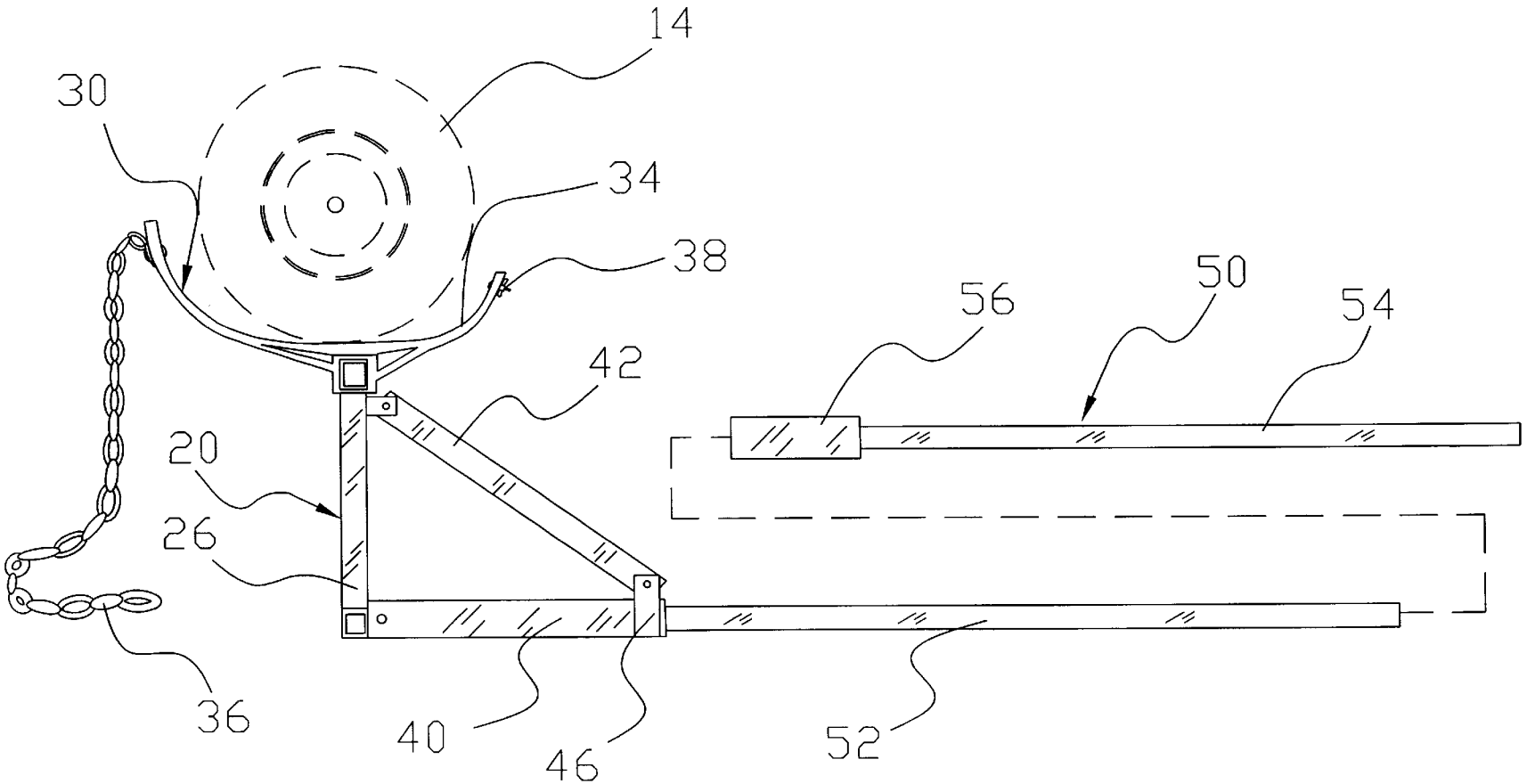
FIG. 5 is a side view of the present invention with the lever arm partially disassembled.
Figure 6:
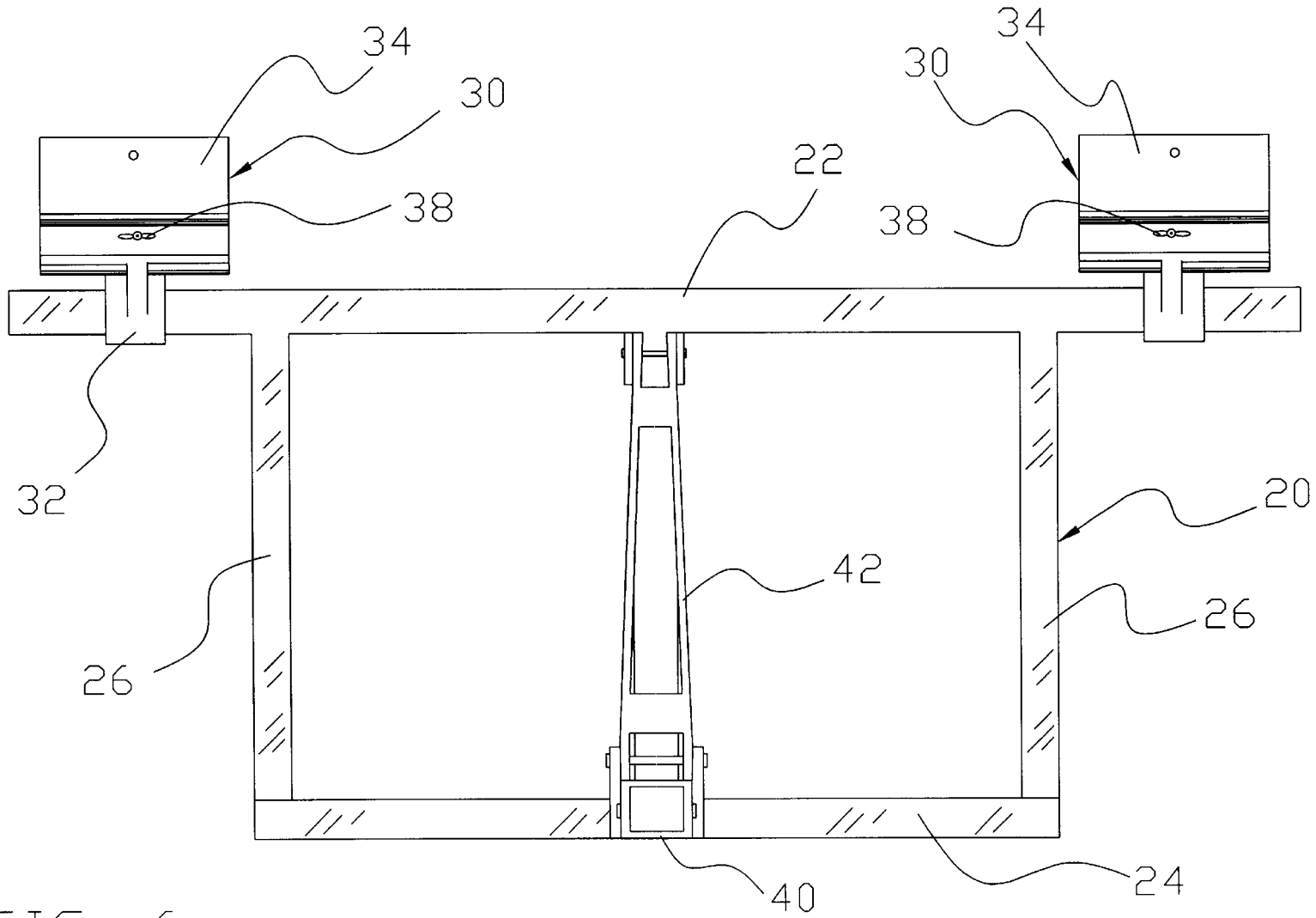
FIG. 6 is a rear view of the present invention.
Figure 7:
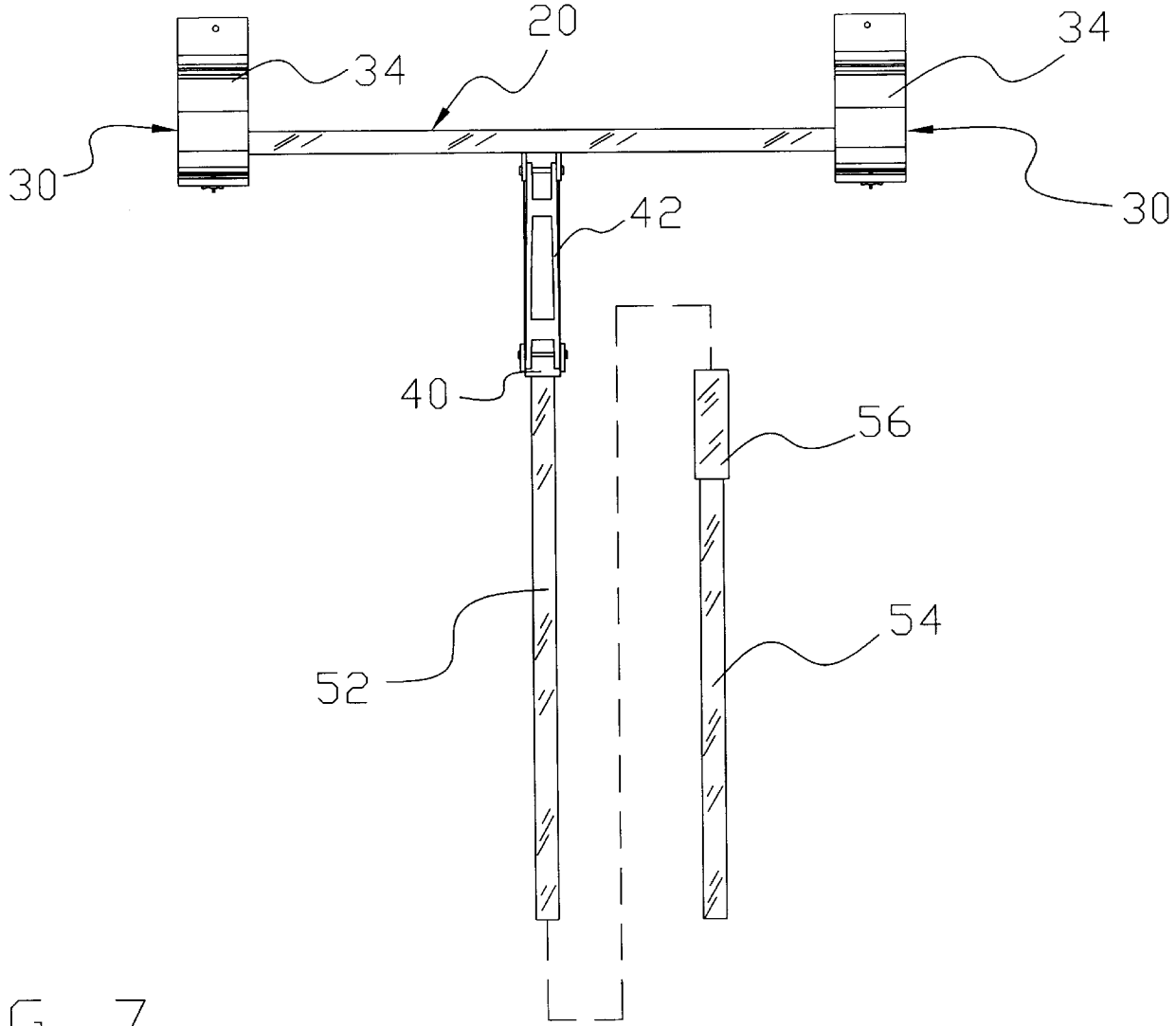
FIG. 7 is a top view of the present invention with the lever arm partially disassembled.

As shown in FIGS. 1, 4, 5, 6 and 7 of the drawings, a pair of wheel supports 30 are attached about opposing portions of the upper member 22. The wheel supports 30 are preferably comprised of a main tube 32 that is removably positionable about the upper member 22 and a support member 34 having a curved shape for receiving the tires 14. The main tube 32 may be permanently attached to the upper member 22 or removably attached using locking pins 44 or other attaching means. The front portion of the support member 34 preferably extends a finite distance further than the rear portion of the support member 34 for allowing the tires 14 of the lawn tractor 12 to be driven upon the support member 34 as best shown in FIGS. 2 and 5 of the drawings.

Figure 2:
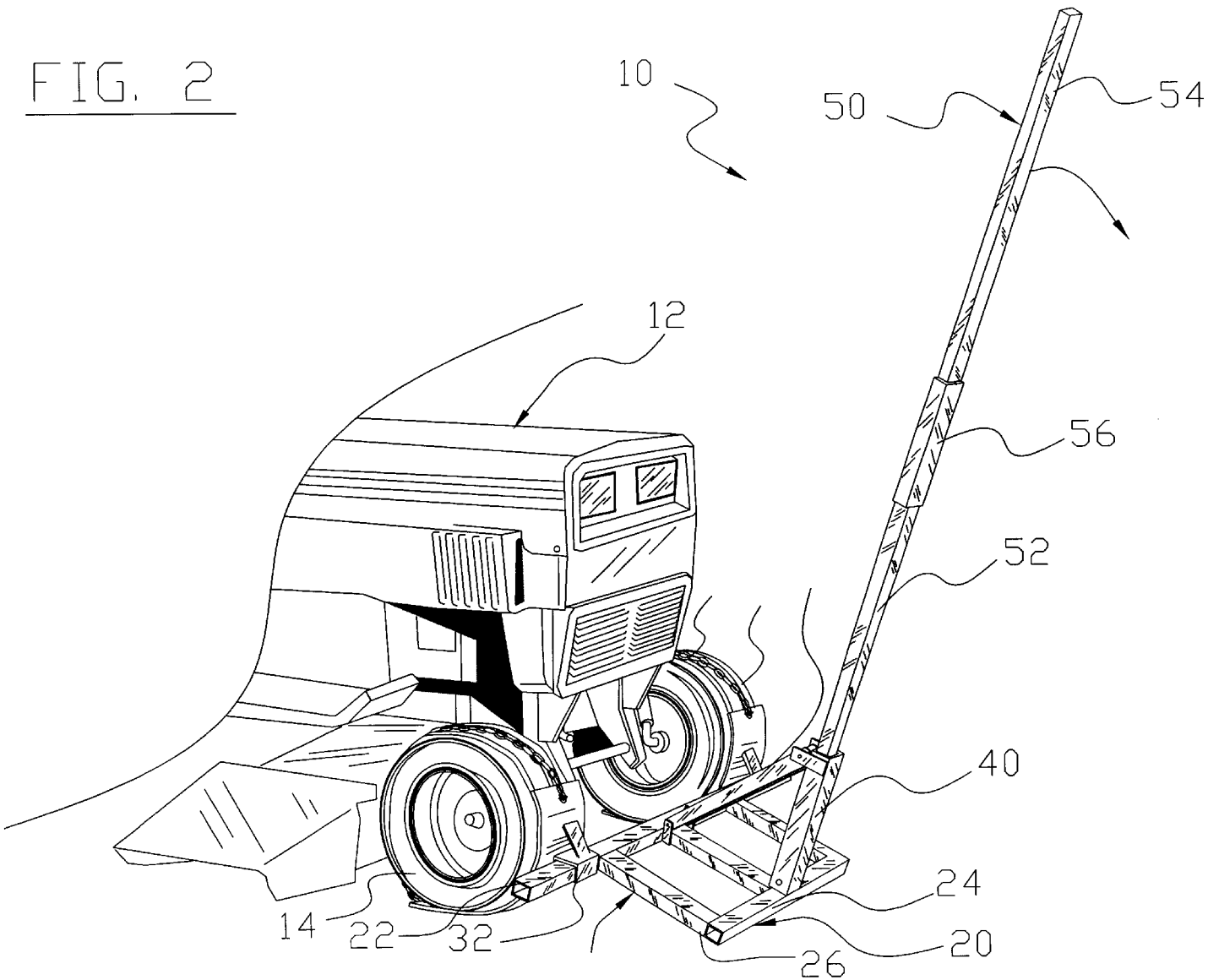
FIG. 2 is an upper perspective view of the present invention with a lawn tractor positioned adjacent thereto.

A length of chain 36 is attached to each of the wheel supports 30 as shown in FIGS. 1, 4 and 5 of the drawings. A securing member 38 is attached to the support member 34 for receiving an opposing portion of the chain 36 for securing about the tires 14 of the lawn tractor 12 during usage. The securing member 38 is preferably comprised of a threaded shaft with a winged nut threadably attached about, however various other common structures may be utilized to construct the securing member 38.

As shown in FIGS. 1, 4 and 5 of the drawings, the lower member 40 is removably attached about the tongue member 28 with one of the locking pins 44 or other structure. The lower member 40 may also be permanently secured about the tongue member 28 or directly to the frame 20. An angled brace 42 is attached between the first bracket 29 and a second bracket 46 for providing support between the distal portion of the lower member 40 and the frame 20.

As shown in FIGS. 1 through 5 of the drawings, a lever arm 50 is attachable to the distal portion of the lower member 40. The lever arm 50 is preferably comprised of a first portion 52 and a second portion 54 connected to one another via a coupler 56 or other well known means. The lever arm 50 is preferably comprised of sufficient length for allowing most individuals to apply sufficient leverage to elevate the front of a lawn tractor 12.

Figure 3:
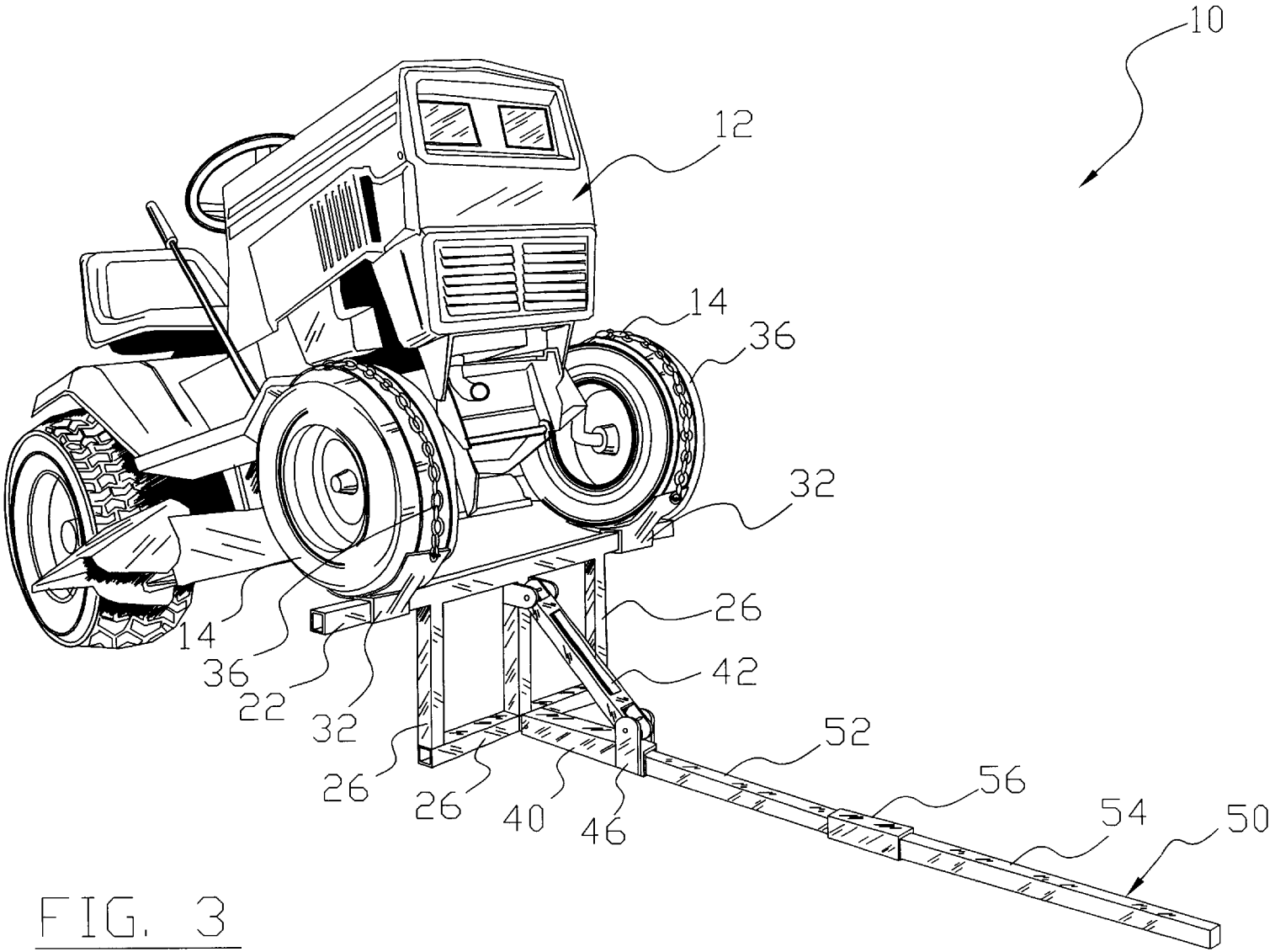
FIG. 3 is an upper perspective view of the present invention supporting the front end of a lawn tractor in an elevated position.

In use, the user tilts the frame 20 and lever arm 50 forwardly until the front portion of each support member 34 of the wheel supports 30 is in engagement with the ground surface. The user then drives the lawn tractor 12 so that the front tires 14 are positioned upon each support member 34 as shown in FIG. 2 of the drawings. Each chain 36 is then secured about the tires 14 to each securing member 38 as shown in FIGS. 2 and 3 of the drawings. The user then applies a downward force upon the lever arm 50 thereby elevating the wheel supports 30 and the front end of the lawn tractor 12 as shown in FIGS. 2 and 3 of the drawings. When the lever arm 50 is substantially parallel to the ground surface, the vertical members 26 are substantially vertically orientated with the ground surface to support the tires 14 of the lawn tractor 12 as shown in FIG. 3 of the drawings. The front tires 14 of the lawn tractor 12 are positioned so that the center vertical forces are applied between the vertical members 26 and the second bracket 46 so that the frame 20 is maintained in a vertical position. The individual is then able to inspect and perform maintenance upon the lawn tractor 12.

When finished inspecting or maintaining the lawn tractor 12, the user then simply elevates the lever arm 50 thereby lowering the front end of the lawn tractor 12. Each chain 36 is removed from the tires 14 and the lawn tractor 12 is driven off the wheel supports 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lawn tractor maintenance system, comprising:

a frame;

a pair of wheel supports attached to said frame, wherein said wheel supports are capable of receiving a pair of tires from a lawn tractor, and wherein said wheel supports are each comprised of a main tube removably attachable about an upper member of said frame and a support member having a curved shape; and a lever arm attached to said frame.

2. The lawn tractor maintenance system of claim 1, wherein a front portion of said support member is longer than a rear portion of said support member.

3. The lawn tractor maintenance system of claim 1, wherein said lever arm is comprised of a first portion, a second portion and a coupler for securing said first portion and said second portion together.

4. The lawn tractor maintenance system of claim 1, including a tongue member attached to a base member of said frame, and a lower member attached to said tongue member, wherein said lower member is formed for receiving said lever arm.

5. The lawn tractor maintenance system of claim 4, including an angled brace extending between an upper portion of said frame and a distal portion of said lower member.

6. The lawn tractor maintenance system of claim 5, wherein said lever arm is comprised of a first portion, a second portion and a coupler for securing said first portion and said second portion together.

7. The lawn tractor maintenance system of claim 1, wherein said frame is comprised of an upper member, a base member, and a plurality of vertical members extending between said upper member and said base member.

8. The lawn tractor maintenance system of claim 7, wherein said lever arm is attached to said base member.

9. The lawn tractor maintenance system of claim 8, including an angled brace extending from said upper member and said lever arm.

10. The lawn tractor maintenance system of claim 1, including a means for securing said tires upon each of said wheel supports.

11. The lawn tractor maintenance system of claim 10, wherein a front portion of said support member is longer than a rear portion of said support member.

12. The lawn tractor maintenance system of claim 10, wherein said lever arm is comprised of a first portion, a second portion and a coupler for securing said first portion and said second portion together.

13. The lawn tractor maintenance system of claim 10, including a tongue member attached to a base member of said frame, and a lower member attached to said tongue member, wherein said lower member is formed for receiving said lever arm.

14. The lawn tractor maintenance system of claim 13, including an angled brace extending between an upper portion of said frame and a distal portion of said lower member.

15. The lawn tractor maintenance system of claim 14, wherein said lever arm is comprised of a first portion, a second portion and a coupler for securing said first portion and said second portion together.

16. The lawn tractor maintenance system of claim 10, wherein said frame is comprised of an upper member, a base member, and a plurality of vertical members extending between said upper member and said base member.

17. The lawn tractor maintenance system of claim 16, wherein said lever arm is attached to said base member.

18. The lawn tractor maintenance system of claim 10, wherein said means for securing is comprised of a length of chain attached to each of said wheel supports and a securing member attached to each of said wheel supports for receiving a distal portion of said chain for securing about each of said tires.

19. A lawn tractor maintenance system, comprising:

a frame;

a pair of wheel supports attached to said frame, wherein said wheel supports are capable of receiving a pair of tires from a lawn tractor;

a lever arm attached to said frame; and a tongue member attached to a base member of said frame, and a lower member attached to said tongue member, wherein said lower member is formed for receiving said lever arm.

* * * * *